US007570775B2

(12) United States Patent
Araki

(10) Patent No.: US 7,570,775 B2
(45) Date of Patent: Aug. 4, 2009

(54) MICROELECTROMECHANICAL SPEAKER

(75) Inventor: Shinichi Araki, Sunnyvale, CA (US)

(73) Assignees: Sony Corporation, Tokyo (JP); Sony Electronics, Inc., Parkridge, NJ (US)

( * ) Notice: Subject to any disclaimer, the term of this patent is extended or adjusted under 35 U.S.C. 154(b) by 960 days.

(21) Appl. No.: 11/072,048

(22) Filed: Mar. 3, 2005

(65) Prior Publication Data

US 2006/0062420 A1 Mar. 23, 2006

Related U.S. Application Data

(60) Provisional application No. 60/610,439, filed on Sep. 16, 2004, provisional application No. 60/628,392, filed on Nov. 16, 2004.

(51) Int. Cl.
*H04R 25/00* (2006.01)

(52) U.S. Cl. ..... 381/191; 381/174

(58) Field of Classification Search ..... 381/170, 381/171, 174, 175, 396, 398, 399, 400, 401, 381/402, 406, 408, 409, 410, 431; 257/416, 257/418

See application file for complete search history.

(56) References Cited

U.S. PATENT DOCUMENTS

| | | | | |
|---|---|---|---|---|
| 3,247,925 | A * | 4/1966 | Warnaka | 381/398 |
| 5,487,114 | A * | 1/1996 | Dinh | 381/406 |
| 6,611,605 | B2 * | 8/2003 | Kim | 381/406 |
| 7,054,460 | B2 * | 5/2006 | Rombach et al. | 381/421 |
| 7,110,564 | B2 * | 9/2006 | Son | 381/396 |

* cited by examiner

*Primary Examiner*—Huyen D Le
(74) *Attorney, Agent, or Firm*—Charles J. Kulas; Trellis IP Law Group, PC

(57) ABSTRACT

Disclosed is a microelectromechanical (MEM) speaker device. In one embodiment, the MEM speaker device includes: (i) a base layer; (ii) a device controller; (iii) a coil layer connected to magnetic material; (iv) an oscillator connected to a spring and the magnetic material; (v) a spring between the oscillator and a support layer; (vi) a protective layer over the oscillator; and (vii) a support post connected to the oscillator, the base layer, the protective layer, and the coil layer. Embodiments of the invention can provide a MEM speaker device where control of the oscillator by electromagnetic force produces sound energy.

14 Claims, 5 Drawing Sheets

FIG. 1A
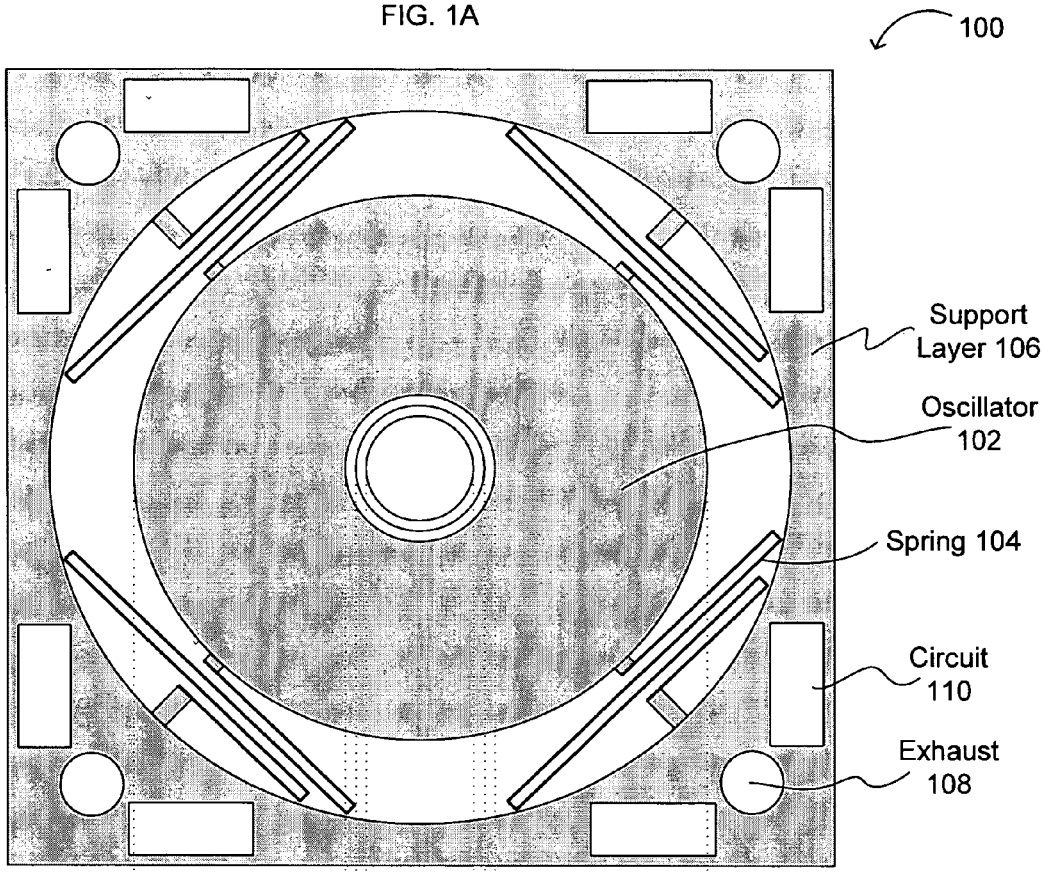
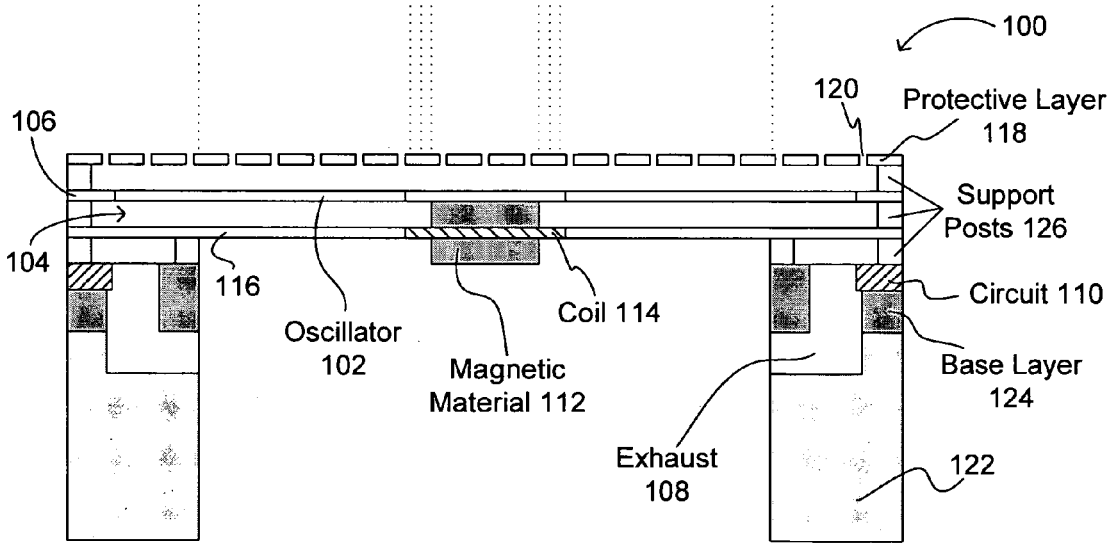
FIG. 1B

FIG. 4A
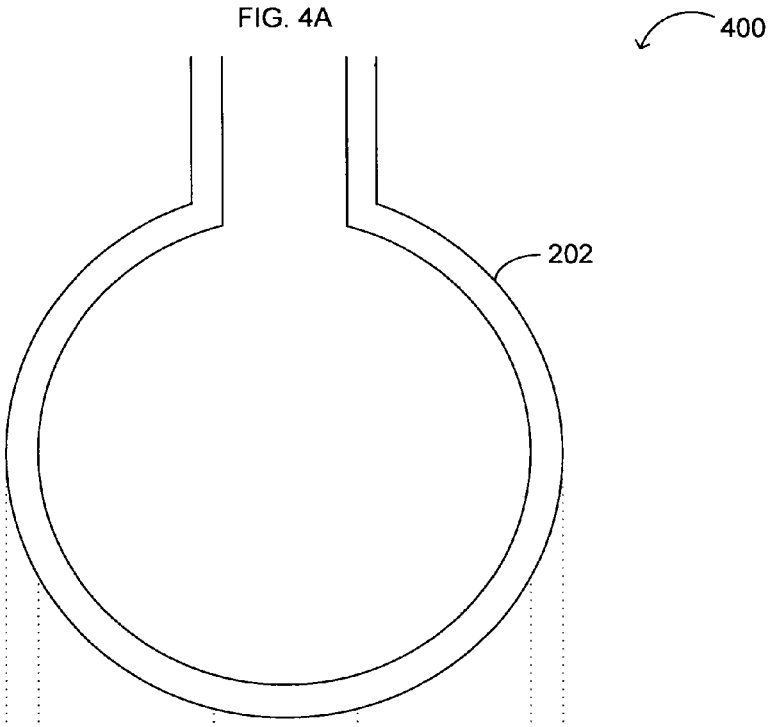
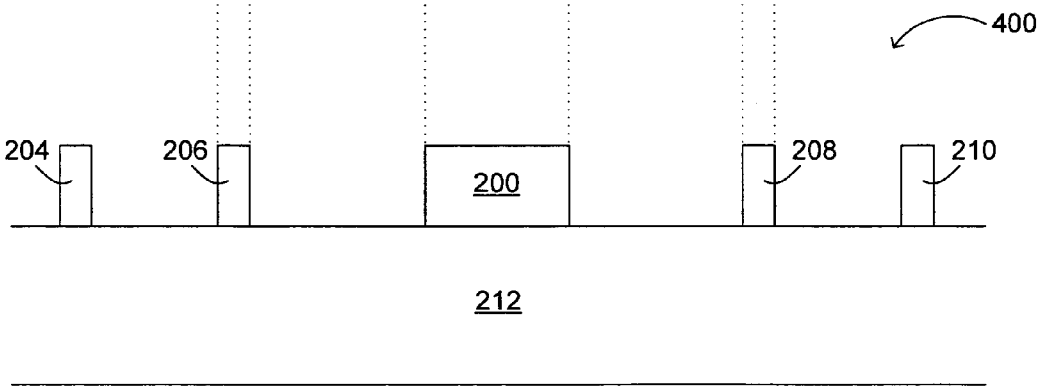
FIG. 4B

MICROELECTROMECHANICAL SPEAKER

RELATED APPLICATIONS

This application claims the benefit of U.S. Provisional Application No. 60/610,439, entitled "Movable Lens Mechanism", filed Sep. 16, 2004, which is incorporated herein by reference in its entirety.

BACKGROUND

Microelectromechanical (MEM) systems (MEMS), such as arrays of small mirrors controlled by electric charges, are known in the art. MEMS devices are desirable because of their small size, potential lower cost, and higher performance. Some types of devices that have been built using MEMS techniques include accelerometers, gyroscopes, temperature sensors, chemical sensors, AFM (atomic force microscope) probes, micro-lenses, actuators, etc. Such devices can be integrated with microelectronics, packaging, optics, and other devices or components to realize complete MEMS systems. Some examples of MEMS systems include inertial measurement units, optical processors, sensor suites, and micro robots.

Although MEMS techniques, and other related fields such as nanotechnology, have been used successfully to fabricate many types of devices, there are still various problems to be overcome in manufacturing increasingly complex devices.

SUMMARY

In one embodiment, a microelectromechanical (MEM) apparatus includes: (i) a base layer; (ii) a device controller; (iii) a coil layer connected to magnetic material; (iv) an oscillator connected to a spring and the magnetic material; (v) a spring between the oscillator and a support layer; (vi) a protective layer over the oscillator; and (vii) a support post connected to the oscillator, the base layer, the protective layer, and the coil layer.

In another embodiment, a MEM device includes: (i) a circular oscillator connected by springs to a support layer; (ii) an exhaust path through the support layer to allow for gas to escape; (iii) magnetic material connected to the circular oscillator; and (iv) a coil around the magnetic material.

Embodiments of the invention can provide a MEM speaker device where control of the oscillator by electromagnetic force produces sound energy.

BRIEF DESCRIPTION OF THE DRAWINGS

FIG. 1A is a top view of a microelectromechanical (MEM) speaker device according to an embodiment of the present invention;

FIG. 1B is a side view of the MEM speaker device of FIG. 1A;

FIG. 4A is a top view of steps in the formation of a MEMS speaker;

FIG. 4B is a side view of steps in the formation of a MEMS speaker;

DETAILED DESCRIPTION

Figure 2A:
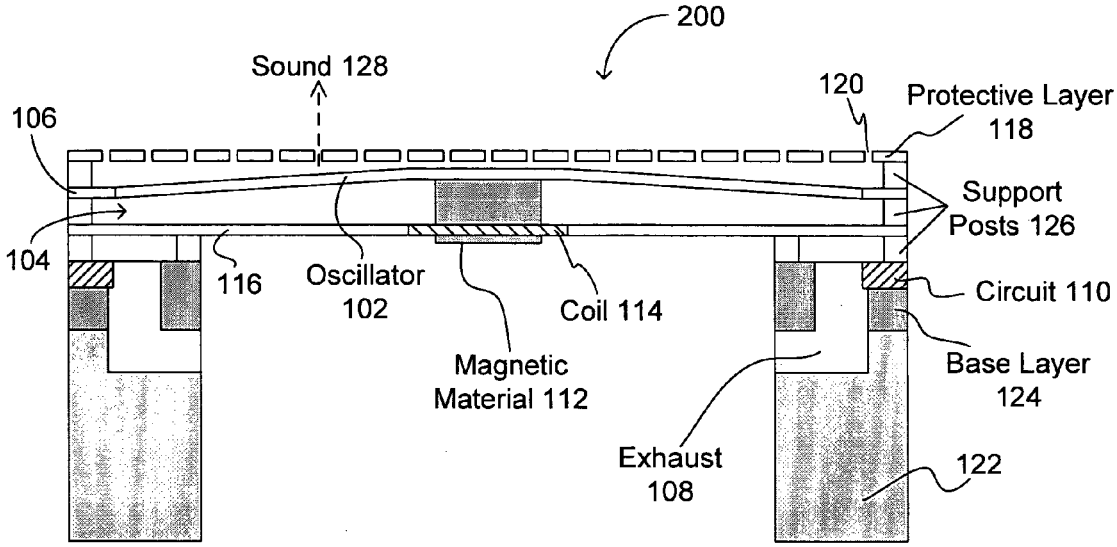
FIG. 2A is a side view of another MEM speaker device showing a movable element in a first position according to an embodiment of the present invention.

In the drawings, well known microelectromechanical systems (MEMS) elements are omitted so as to more clearly illustrate embodiments of the invention. Like-numbered elements shown in two or more drawings illustrate the same or substantially similar elements. Embodiments are fabricated on, for example, a silicon wafer using known MEMS fabrication methods (using, e.g., silicon oxide and electrically conductive aluminum layers). Some embodiments are formed such that electronic circuits that include semiconductor electronic devices (e.g., electronic audio circuits that include transistors) and that are associated with the disclosed MEMS device are formed on the same integrated circuit chip.

Referring now to FIG. 1A, a top view of a microelectromechanical (MEM) speaker device according to an embodiment of the present invention is shown and indicated by the general reference character 100. The speaker assembly includes a movable oscillator element 102 suspended by four serpentine-shaped springs 104 approximately equally spaced around oscillator 102's perimeter. Springs 104 are attached between oscillator element 102 and support layer 106. Exhaust ports 108, illustratively shown in support layer 106 and spaced around oscillator 102, allow gas (e.g., air) to move into and out of the space underneath oscillator element 102 as it moves. In some embodiments, exhaust ports 108 are formed to provide a "bass-reflex" type function. Illustrative electronic circuit 110 contains electronic circuit elements that control the movement of oscillator element 102.

Referring now to FIG. 1B, a side view of the MEM speaker device of FIG. 1A is shown and also indicated by the general reference character 100. Magnetic material 112 is shown suspended from the center of oscillator element 102. An electrically conductive coil 114 surrounds magnetic material 112. The magnitude and/or direction of electric current in coil 114 causes magnetic material 112 to move, in turn causing oscillator element 102 to move. The movement of oscillator 102 causes sound waves that are of sufficient magnitude and appropriate frequencies to be detected by the human ear, for example. Coil 114 is shown formed in coil layer 116, which is shown positioned underneath (i.e., nearer to the underlying substrate than) oscillator element 102. In other embodiments, coil layer 116 is positioned over oscillator element 102. One or more electronic circuits 110 control electric current in coil 114 and may be coupled via electrically conductive traces on coil layer 11.6 to coil 114.

FIG. 1B also shows a protective layer 118 positioned substantially over oscillator element 102. Holes 120 are positioned in protective layer 118 to allow sound energy generated by oscillator 102 to pass through protective layer 118. Protective layer 118 protects oscillator element 102 from damage and may be omitted in some embodiments.

The illustrative speaker assembly 100 is shown formed on substrate 122 (e.g., silicon) with electronic circuits formed in an overlying base layer 124. Further, coil layer 116 is overlying base layer 124, support layer 106 is overlying coil layer 116, and protective layer 118 is overlying support layer 106. Support posts 126 separate layers 124, 116, 106, and 118, as shown.

Referring now to FIG. 2A, a side view of another MEM speaker device showing a movable element in a first position according to an embodiment of the present invention is shown and indicated by the general reference character 200. The MEM speaker side view of FIG. 2A shows oscillator element 102 in a first position, displaced upward by electromagnetic force generated between magnetic material 112 and coil 114. This upward displacement causes a gas (e.g., air) pressure wave (e.g., sound energy) 128 to travel outward through holes 120 in protective layer 118, as illustrated.

Figure 2B:
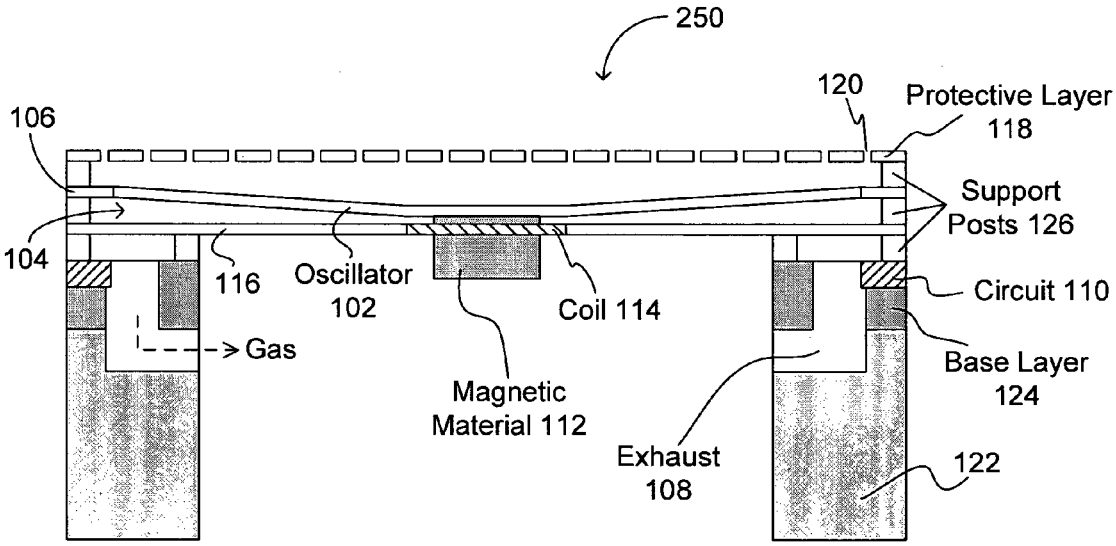
FIG. 2B is a side view of the MEM speaker device of FIG. 2A showing the movable element in a second position.

Referring now to FIG. 2B, a side view of the MEM speaker device of FIG. 2A showing the movable element in a second position is shown and indicated by the general reference character 250. Oscillator element 102 is shown in a second position, displaced downward by electromagnetic force generated between magnetic material 112 and coil 114. This downward displacement causes gas to move through exhaust ports 108 (and, in some embodiments, outward through holes 120 in protective layer 118). In some embodiments, electromagnetic force displaces oscillator 102 in substantially only one direction and the inherent material resiliency of springs 104 causes oscillator 102 to either return to its static (i.e., inactivated) position or to displace through its inactivated position until again moved with electromagnetic force. Accordingly, in some embodiments, a sufficiently timed and periodic electric current pulse in coil 114 causes oscillator element 102 to oscillate. Other waveforms (e.g., sine, square, etc.) may be used in coil 114 to activate oscillator element 102.

Figure 3A:
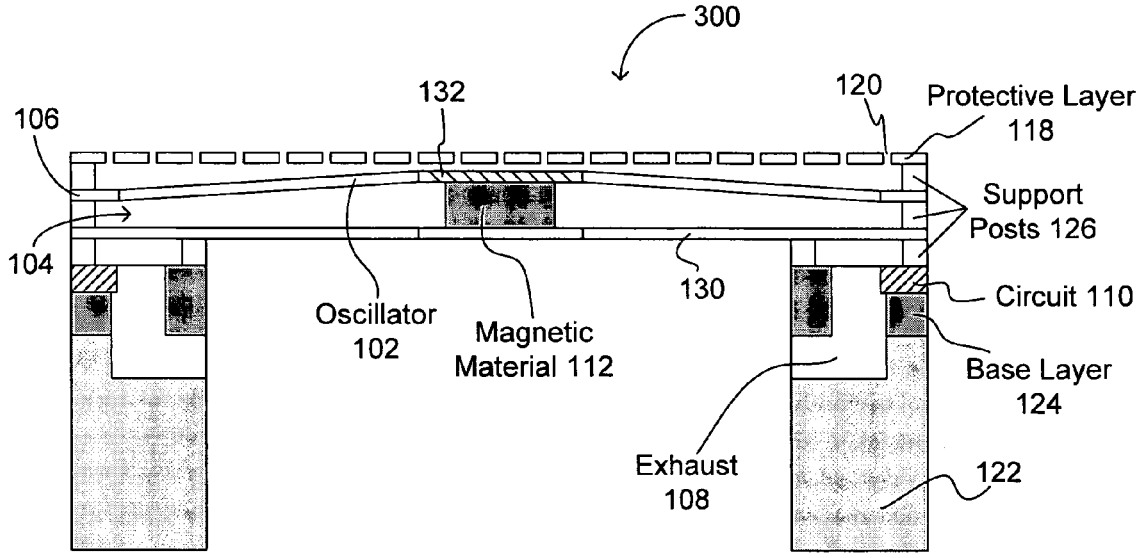
FIG. 3A is a side view of another MEM speaker embodiment showing a movable element in a first position.

Referring now to FIG. 3A, a side view of another MEM speaker embodiment showing a movable element in a first position is shown and indicated by the general reference character 300. Magnetic material 112 is mounted on a magnet support layer 130 underlying oscillator element 102, to provide a rigid coupling of the magnetic material 112 to the substrate 122. An electrically conductive coil 132 on oscillator element 102 is positioned around magnetic material 112. As one example, current in coil 132 is controlled by circuit 110 coupled to coil 132 by electrically conductive traces on springs 104 and oscillator element 102.

Figure 3B:
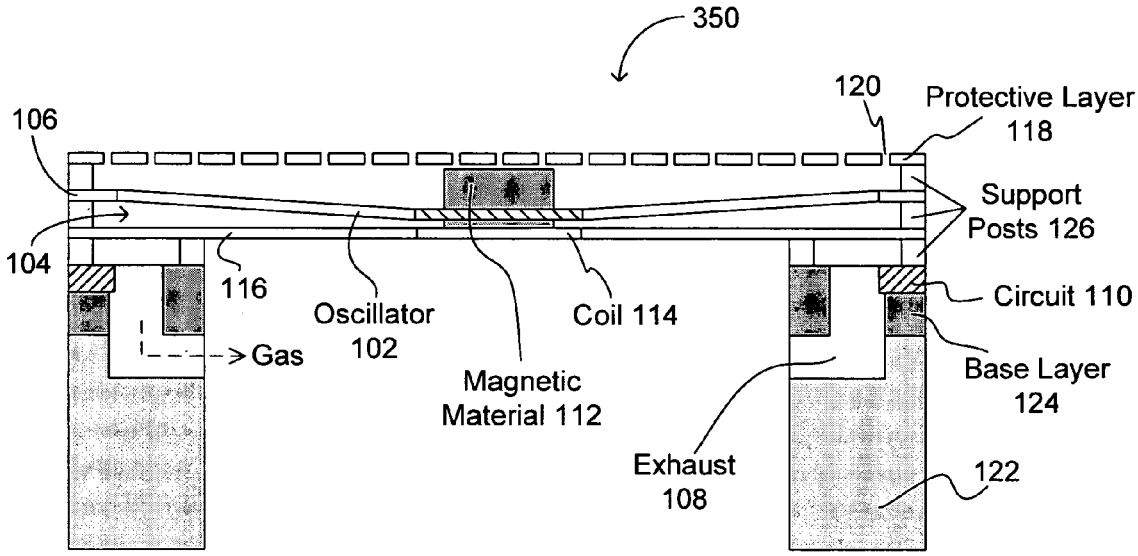
FIG. 3B is a side view of the MEM speaker device of FIG. 3A showing the movable element in a second position.

Referring now to FIG. 3B, a side view of the MEM speaker device of FIG. 3A showing the movable element in a second position is shown and indicated by the general reference character 350. Similar to FIG. 2B, as described above, oscillator element 102 is shown in a second position, displaced downward by electromagnetic force generated between magnetic material 112 and coil 114. This downward displacement causes gas to move through exhaust ports 108 (and, in some embodiments, outward through holes 120 in protective layer 118). In some embodiments, electromagnetic force displaces oscillator 102 in substantially only one direction and the inherent material resiliency of springs 104 causes oscillator 102 to either return to its static (i.e., inactivated) position or to displace through its inactivated position until again moved with electromagnetic force. Accordingly, in some embodiments, a sufficiently timed and periodic electric current pulse in coil 114 causes oscillator element 102 to oscillate. Other waveforms (e.g., sine, square, etc.) may be used in coil 114 to activate oscillator element 102.

Accordingly, embodiments of the present invention allow for the moving of an oscillator element using electromagnetic force. Further, particular embodiments place a coil in the layer of the oscillator element or in a coil layer located below the oscillator element. In either such embodiment, the coil surrounds a magnetic material.

Magnetic material 112 has been illustrated herein as being substantially a material with associated magnetic properties. However, in some embodiments, electrically conductive coils on both oscillator element 102 and on another layer may be used to provide the electromagnetic force necessary to move oscillator element 102. Various other combinations of magnetic material and electrically conductive coils may be also be used (e.g., coils located above and below oscillator element 102).

Oscillator 102 may be formed using a semiconductor material, such as silicon, polysilicon, doped polysilicon, single silicon, gallium arsenide (GaAs), gallium nitride (GaN), indium gallium nitride (InGaN), gallium aluminum phosphide (GaAlP), gallium phosphide (GaP), silicon germanium (SiGe), silicon nitride ($Si_3N_4$), titanium nitride (TiN), titanium silicon nitride (TiSiN), molybdenum (Mo), and aluminum nitride (AlN). Also, support posts 126 may be made of nitride glass (SiN). Other materials used to fabricate semiconductor and/or microelectromechanical (MEM) machines may be used for these and the other structures shown and described. Further, fabrication may be done using known semiconductor and MEM machine fabrication procedures.

The space surrounding oscillator 102 may be air, other gas, or a substantial vacuum (e.g., the apparatus is sealed from the ambient environment). Base layer 124 may include discrete areas for providing control signals, such as address-based control, for controlling the movement of oscillator 102. Substrate 122 may include control circuitry in or communicating through the discrete areas of base layer 124. The control circuitry can be fabricated using any appropriate processing technology, such as CMOS, bipolar, or BiCMOS technology.

FIGS. 4A and 4B illustrate early steps in the formation of an exemplary MEMS speaker and are indicated by the general reference character 400. FIG. 4A shows a top view of magnetic material 200 surrounded by coil 202. Although the magnetic material is shown as a disc-shaped core, other shapes can be used. Coil 202 substantially surrounds magnetic material 200 and can similarly be of different shapes. Although only a single loop of the coil is shown in FIG. 4A, in practice, multiple loops are used. The loops can be separate from each other or connected as in, e.g., a spiral pattern.

FIG. 4B shows a cross section of the structures of FIG. 4A. In FIG. 4B, magnetic material 200 is formed on substrate 212. Magnetic material can be NiFe and can be formed on a silicon substrate by, e.g., sputtering through sacrificial layers (not shown) or by other suitable techniques. The cross-sectional view shows two portions of coil 202 as coil cross sections 206 and 208. Additional cross sections 204 and 210 are shown for an additional coil loop. The coil can be formed from tungsten, aluminum or other conducting metal and can similarly be sputtered, vapor deposited, or formed on the substrate using other approaches.

Figure 5:
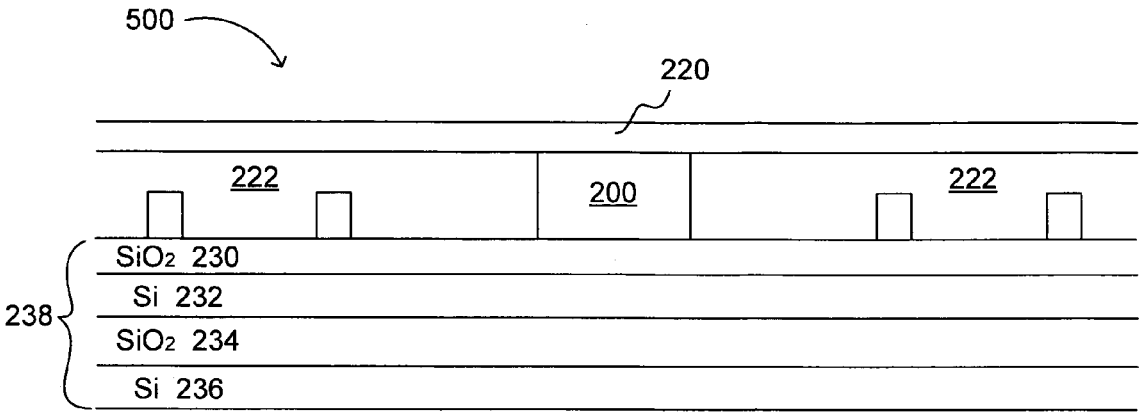
FIG. 5 shows steps in the formation of an oscillator section of the MEMS speaker.

FIG. 5 shows a step in formation of the MEMS speaker whereby the coil sections have been covered with PIQ, or a polyimid layer and is indicated by the general reference character 500. This allows formation of plate 220 that is the speaker plate, or oscillator 102 of FIG. 1A. The oscillatorcan be formed of polysilicon or other suitable compounds or elements. The polysilicon can be secured to the NiFe by performing laser annealing. The substrate is shown in more detail as including $SiO_2$ layer 230, Si layer 232, $SiO_2$ layer 234 and Si layer 236. These substrate layers are indicated as substrate layers 238.

Figure 6:
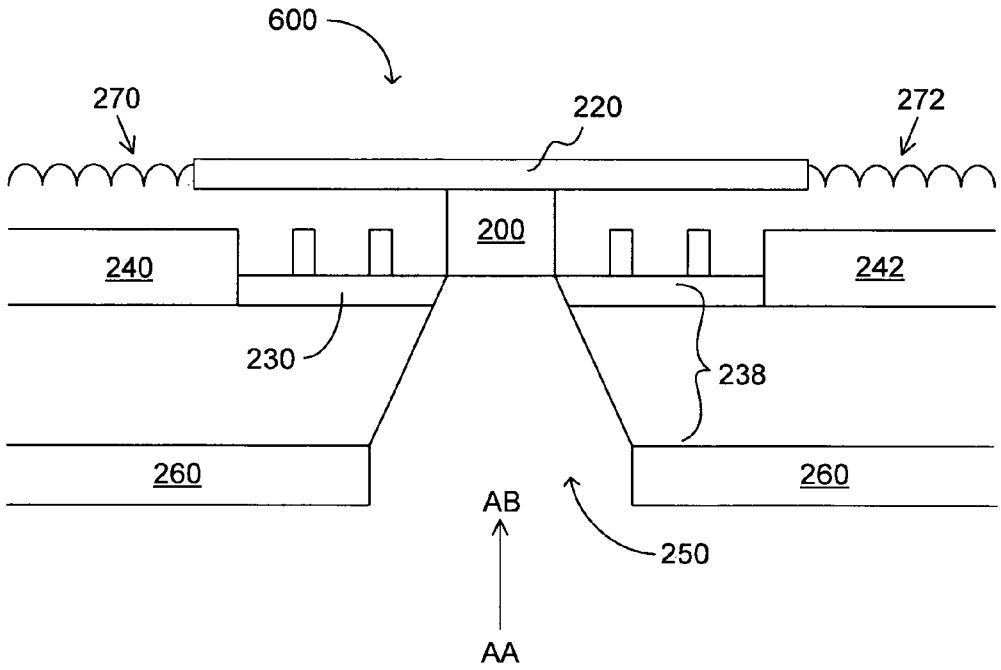
FIG. 6 shows additional steps including back-etching.

FIG. 6 shows a larger-scale view (note that the FIGS herein are not to any particular relative or absolute scale) of the structures of FIG. 5 after oscillator 220 formation and is indicated by the general reference character 600. The polimid layer 222 has been removed so that the area under the oscillator is air, gas, or vacuum. Springs 270 and 272 can be formed using known MEMS techniques and can be any suitable type of flexible support. Areas 240 and 242 are used for metal-oxide semiconductor (MOS) formation of circuitry, such as actuator control circuitry, signal processing, etc. A portion of substrate layers 238 are removed at 250 by forming nitride mask 260 and using KoH back etching in the direction AA-AB. Plasma etching can also be used to facilitate removal of $SiO_2$ layers.

Although the invention has been described with respect to specific embodiments thereof, these embodiments are merely illustrative, and not restrictive, of the invention. For example, various other configurations are possible, such as other shapes for the springs or other exhaust port structures, for example. Different approaches to actuating the magnetic material and oscillator are possible. For example, a coil can be included on the surface of the oscillator and the coil can interact (i.e., electrically attract and/or repel) with a coil on the substrate.

Aspects of the invention may be realized on different size scales than those presented herein. Although MEMS techniques have primarily been presented, macro, nano or other designs, sizes and fabrication techniques at different scales may be used to advantage in different embodiments.

In the description herein, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

Further, as used herein, "above," "below," "underlying," "overlying" and the like are used primarily to describe possible relations between elements, but should not be considered otherwise limiting. Such terms do not, for example, necessarily imply contact with or between elements or layers.

Embodiments of the invention may be implemented by using a programmed general purpose digital computer, by using application specific integrated circuits (ASICs), programmable logic devices (PLDs), field programmable gate arrays (FPGAs), optical, chemical, biological, quantum or nanoengineered systems, components and mechanisms may be used. In general, the functions of the present invention can be achieved by any means as is known in the art. Distributed, networked systems, and/or components and circuits can be used. Communication, or transfer, of data may be wired, wireless, or by any other means.

It will also be appreciated that one or more of the elements depicted in the drawings/figures can also be implemented in a more separated or integrated manner, or even removed or rendered as inoperable in certain cases, as is useful in accordance with a particular application. It is also within the spirit and scope of the present invention to implement a program or code that can be stored in a machine-readable medium to permit a computer to perform any of the methods described above.

Additionally, any signal arrows in the drawings/FIGS should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims.

What is claimed is:

1. An apparatus comprising:

a substrate;

a microelectromechanical oscillator flexibly coupled to the substrate, wherein the microelectromechanical oscillator is formed on the substrate using one or more semiconductor process steps;

a first magnet rigidly coupled to the substrate;

a coil coupled to the microelectromechanical oscillator;

one or more springs flexibly coupling the microelectromechanical oscillator to the substrate; and a circuit electrically coupled to the coil by one or more traces on the one or more springs.

2. The apparatus of claim 1, wherein the first magnet comprises an inherently magnetic material.

3. The apparatus of claim 1, wherein the first magnet comprises an electromagnet.

4. The apparatus of claim 1, wherein the coil comprises an electromagnet.

5. The apparatus of claim 4, wherein the electromagnet comprises an electrically conductive loop positioned around the first magnet.

6. The apparatus of claim 1, wherein the one or more springs are formed in a serpentine shape.

7. The apparatus of claim 1 further comprising:

a protective layer positioned over the microelectromechanical oscillator; and a hole in the protective layer, the hole being a size sufficient to allow sound energy generated by the microelectromechanical oscillator to pass through the protective layer.

8. The apparatus of claim 1, wherein the circuit is positioned on the substrate.

9. The apparatus of claim 1 further comprising an exhaust port positioned in a layer coupled to the substrate, wherein the exhaust port allows a gas between the microelectromelectroechanical oscillator and the substrate to flow through the exhaust port as the microelectromelectroechanical oscillator moves towards the substrate.

10. The apparatus of claim 1, wherein the microelectromechanical oscillator comprises a substantially flat surface, and wherein a major portion of sound energy generated by movement of the microelectromechanical oscillator is in a direction substantially orthogonal to the plane of the substantially flat surface.

11. The apparatus of claim 1, wherein the substrate comprises silicon.

12. The apparatus of claim 1, wherein the microelectromechanical oscillator includes one or more of the following: silicon, polysilicon, doped polysilicon, single silicon, gallium arsenide (GaAs), gallium nitride (GaN), indium gallium nitride (InGaN), gallium aluminum phosphide (GaAlP), gallium phosphide (GaP), silicon germanium (SiGe), silicon nitride (Si3N4), titanium nitride (TiN), titanium silicon nitride (TiSiN), molybdenum (Mo), or aluminum nitride (AlN).

13. The apparatus of claim 1, wherein at least one support post is used to couple the microelectromechanical oscillator to the substrate.

14. The apparatus of claim 13, wherein the at least one support post includes nitride glass (SiN).

* * * * *